US005551093A

United States Patent [19]

Stricker

[11] Patent Number: 5,551,093

[45] Date of Patent: Sep. 3, 1996

[54] EXTRA PROTECTION UNDERGARMENT

[76] Inventor: Mildred L. Stricker, P.O. Box 18652, St. Louis, Mo. 63118

[21] Appl. No.: 312,517

[22] Filed: Sep. 26, 1994

[51] Int. Cl.[6] ..... A41B 9/00

[52] U.S. Cl. ..... 2/406; 2/400; 2/401; 2/402; 604/385.1; 604/395

[58] Field of Search ..... 2/400, 401, 402, 2/403, 406, 408, 73; 604/395.1, 385.1, 385.2

[56] References Cited

U.S. PATENT DOCUMENTS

| | | | |
|---|---|---|---|
| 1,975,688 | 10/1934 | Graves | 2/406 X |
| 2,018,782 | 10/1935 | Gephart | 2/406 X |
| 2,085,425 | 6/1937 | Goodwin | 2/406 |
| 2,088,800 | 8/1937 | Malouf | 2/406 |
| 2,419,867 | 4/1947 | Woodman | 2/406 X |
| 2,450,168 | 9/1948 | Schwartz | 2/406 |
| 3,774,241 | 11/1973 | Zerkle | 2/406 |
| 4,612,674 | 9/1986 | Hashimoto | 2/406 |
| 4,668,230 | 5/1987 | Damico et al. | 604/385 A |
| 5,204,997 | 4/1993 | Suzuki et al. | 2/406 X |

*Primary Examiner*—Jeanette E. Chapman

[57] ABSTRACT

An undergarment including an outer layer and a coextensive inner lining. The undergarment is substantially rectangular and it also includes fastening elements adjacent the sides for securing the undergarment to the wearer. Elastic ruffles extend along each side of the undergarment from adjacent the middle of the garment to adjacent the fastening elements. When the garment is worn the elastic ruffles are present on each side of the front portion of the undergarment to cause the garment to conform to the curves of the wearer. The ruffles terminate at the crotch of the wearer. The undergarment is of such a width that the back portion will cup in, where it meets the ruffles, at the back of the inside of the legs.

1 Claim, 1 Drawing Sheet

EXTRA PROTECTION UNDERGARMENT

BACKGROUND OF THE INVENTION

The undergarments on the market today are long and rectangular and include padding or other materials sandwiched between an inner lining and a waterproof fabric. The garment may include narrow elastic ruffles and a button hole on each corner for two elastic straps. This garment construction is alright but it does not conform to the curves of the body to provide a better fit. In contrast the present undergarment is constructed to conform to the curves in the front and in the rear of the body. The present undergarment adds more width without adding additional bulk. The improvement in fit of the disclosed undergarment provides a better degree of security and also provides a better fit for the wearer.

SUMMARY OF THE INVENTION

The group of elastic ruffles or gathers on a known prior art product is moved forward about 3 and ½ inches so that they will spread out in front and turn down on the inside of the legs. The ruffles are made about one inch wider than the known prior art adding about two inches to the width of the garment. Termination of the ruffles at the back will cause the back to cup in and not flare out. The ruffles will hug the legs. The added two inches of width will allow shorter fastening straps than were present in the known prior art product.

DETAILED DESCRIPTION OF THE PREFERRED EMBODIMENT

Figure 1:
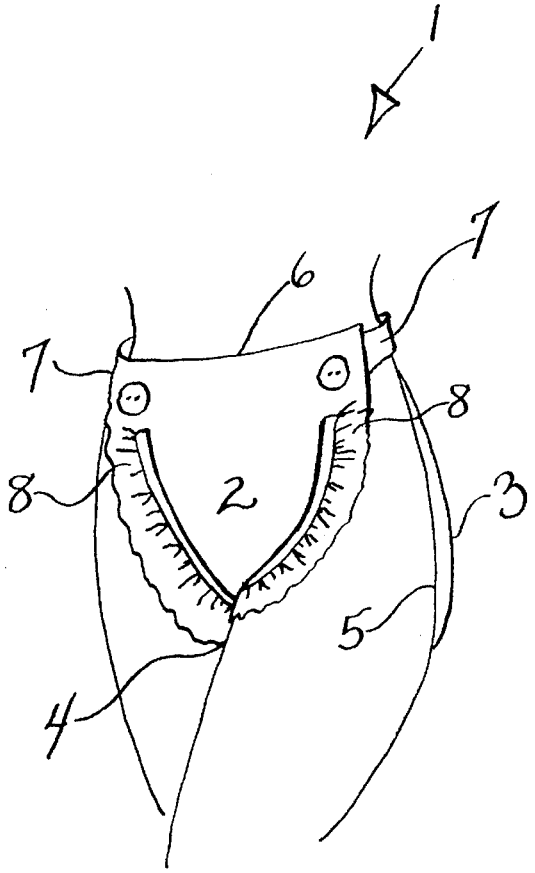
FIG. 1 is a perspective view of the garment as it is worn on the wearer.
Figure 2:
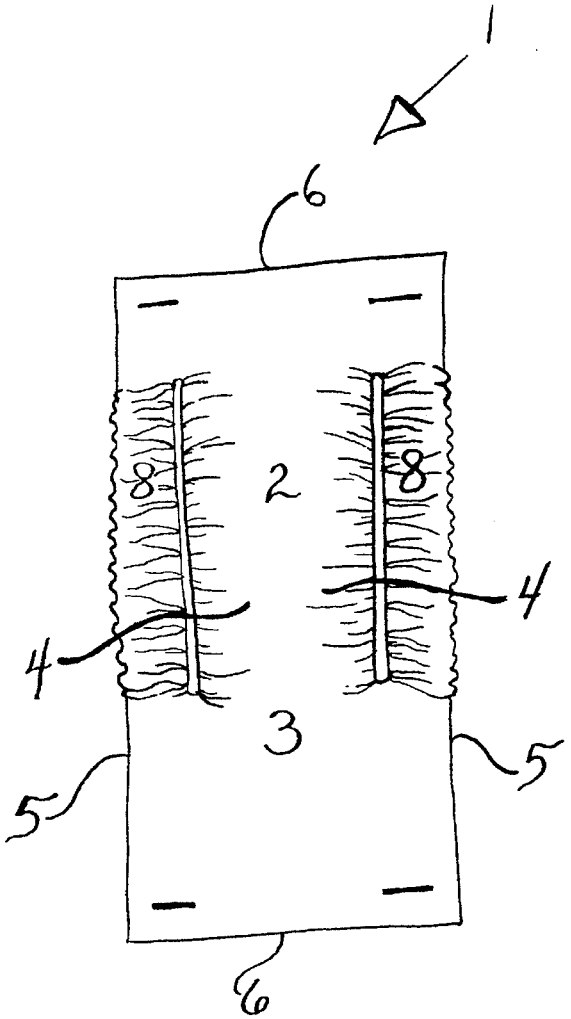
FIG. 2 shows the garment laid out flat in its unworn condition.

Referring to FIGS. 1 and 2, an undergarment 1 in accordance with the present invention is generally comprised of a waterproof outer layer and a coextensive inner lining(not shown). The undergarment is substantially rectangular when laid out flat in the unworn condition as shown in FIG. 2. The undergarment 1 also includes a front portion 2 for covering the lower abdomen of a wearer, a rear portion 3 for covering the buttocks of a wearer and a middle portion 4 connecting the front and rear portions ⅔ and extending through the crotch of a wearer. The garment also includes a two sides and two ends 5 and 6. Fastening elements 7 are adjacent the points where the sides meet the ends for securing the under garment to the wearer. Elastic ruffles 8 extend along each side of the undergarment from adjacent the middle of the undergarment to adjacent the fastening elements so that when the garment is worn, the elastic ruffles 8 are present on each side 5 of the front portion 2 of the undergarment 1 so as to cause the undergarment 1 to conform to the curves of the body, and wherein the ruffles terminate at the crotch of the wearer so that the ruffles curve down and around the inside of the wearer's legs to hug the legs for extra protection. The undergarment is of a width such that the back portion will cup in, where it meets the ruffles at the back of the inside of the legs.

While only one embodiment of the present invention has been shown and described, it will be understood that various modifications and changes could be made without departing from thereunto without departing from the spirit and scope of the invention.

I claim:

1. An undergarment comprising a waterproof outer layer and a coextensive inner lining, the undergarment being oblong when laid out flat in the unworn condition and comprising a front portion for covering the lower abdomen of a wearer, a rear portion for covering the buttocks of a wearer, and a middle connecting the front and rear portions and extending through the crotch of a wearer, the garment also having two sides and tow ends;

fastening elements on the front and rear portions adjacent the points where the sides meet the ends for securing the undergarment to a wearer;

elastic ruffles extending along each side of the undergarment from adjacent the middle of the garment to adjacent the fastening elements on the front portion so that, when the garment is worn, the elastic ruffles are present on each side of the front portion of the undergarment so as to cause the garment to conform to the curves of the body, and wherein the ruffles terminate at the crotch of the wearer so that the ruffles curve down and around the inside of the legs to hug the legs for extra protection;

the undergarment being of a width such that the back portion will cup in, where it meets the ruffles, at the back of the inside of the legs.

* * * * * .